United States Patent [19]

Kwasnik et al.

[11] 4,312,712

[45] Jan. 26, 1982

[54] COKE CAR FOR A BATTERY OF COKE OVENS

[75] Inventors: Hans-Jurgen Kwasnik, Herne; Hans-Gunter Piduch, Bochum, both of Fed. Rep. of Germany

[73] Assignee: Dr. C. Otto & Comp. G.m.b.H., Bochum, Fed. Rep. of Germany

[21] Appl. No.: 151,167

[22] Filed: May 19, 1980

[30] Foreign Application Priority Data

May 17, 1979 [DE] Fed. Rep. of Germany ..... 2919956

[51] Int. Cl.[3] ..... C10B 39/04; C10B 39/14

[52] U.S. Cl. ..... 202/229; 201/39; 105/257

[58] Field of Search ..... 201/39; 202/227, 229, 202/230, 263; 105/254, 255, 257

[56] References Cited

U.S. PATENT DOCUMENTS

| | | | |
|---|---|---|---|
| 2,232,116 | 2/1941 | Koppers | 202/227 |
| 3,924,543 | 12/1975 | Mantione | 105/257 |
| 3,959,083 | 5/1976 | Goedde et al. | 202/227 X |
| 4,141,796 | 2/1979 | Clark et al. | 201/39 |
| 4,213,827 | 7/1980 | Calderon | 201/39 |

FOREIGN PATENT DOCUMENTS

| | | | |
|---|---|---|---|
| 2714792 | 10/1978 | Fed. Rep. of Germany | 202/227 |
| 652955 | 3/1929 | France | 202/227 |
| 1424155 | 11/1965 | France | 105/257 |
| 124652 | 4/1919 | United Kingdom | 202/227 |

*Primary Examiner*—Frank W. Lutter
*Assistant Examiner*—Roger F. Phillips
*Attorney, Agent, or Firm*—Thomas H. Murray; Clifford A. Poff

[57] ABSTRACT

A coke car is moved along a battery of coke ovens to a location for receiving coke from an oven chamber while the car is stationary and for moving to beneath a quenching tower. The coke car includes a generally square box-like container having side walls sealed with a floor that is pivoted about a horizontal axis to bear against seal members. The horizontal axis is spaced from the wall of the car adjacent the coke bench by a distance less than the distance between the axis and the wall of the car adjacent the oven platform. The seal members are disposed on the top of part of the floor which moves away from a side wall during pivotal movement and seal members are disposed on the bottom of a floor part which moves upwardly along a wall of the container during pivotal movement.

7 Claims, 5 Drawing Figures

COKE CAR FOR A BATTERY OF COKE OVENS

BACKGROUND OF THE INVENTION

This invention relates to a coke car which can travel along a battery of coke ovens and, when stationary, serves to receive carbonized coke from an oven chamber and move to beneath a quenching tower, i.e., a one-point quench car.

The area in the container for coke in a car of this type should be equivalent to the area in an inclined coke car of the type which has been conventional for decades. The length and depth of the coke car should be such that when the car is situated in front of an oven chamber from which a coke cake is to be discharged, the car can receive the entire coke cake at the angle at which the body of coke slopes without projecting into a hood disposed above the car on a coke cake guide grid. The hood is used to extract the smoke and/or fumes that forms when the coke is pushed from the oven chamber. The fumes and smoke which form during the pushing of coke are fed from the hood to a discharge pipe extending along the battery of coke ovens.

SUMMARY OF THE INVENTION

It is an object of the present invention to provide a coke transfer car embodying a design whereby the heretofore track for a conventional inclined car can be retained, i.e., the track does not have to be lowered, and without the need for changes to the structure of the coke-side bench.

It is another object of the present invention to provide a coke car for the quenching of coke in a container of the car beneath a quenching tower for adequate cooling of the coke while wetting thereof is kept within required limits.

More specifically, according to the present invention there is provided a coke car to travel along a battery of coke ovens and a coke bench for receiving carbonized coke when stationary from a coke oven chamber and for moving to beneath a quenching tower, the battery of coke ovens having an oven platform at the coke discharge side thereof, the car including a generally square box-like container having side walls with a seal means at the bottom thereof, a floor adapted to bear against the seal means through pivotal movement about a horizontal axis extending in the direction of travel by the car so that pivoting of the floor into a swung-up position permits quenched coke to fall onto the coke bench, and pivotal means for the floor defining the horizontal axis which is spaced from the coke bench when the car is opposite thereto by a distance less than the distance between the horizontal axis and the oven platform when the car is opposite thereto.

Thus, the present invention provides a coke car having a container for receiving a red-hot coke cake in the general form of a square box with a floor with side edges to bear against the bottom edges of the side walls through the agency of a sealing strip. The floor is pivotal about a horizontal axis which extends in the direction of travel by the car. The distance between the horizontal axis and the coke-side bench is less than the distance between the horizontal axis and the oven platform. In the pivoted position, the floor is substantially in line with the surface of the coke bench so that quenched coke can slide onto the bench through an opening formed between the front wall of the container and the pivotally-positioned floor. This opening is sufficiently large for the passage of quenched coke from the car and thereby eliminates the requirement for a separate closure system.

When the floor is pivoted to a position where it forms a bottom closure for the container of the coke car, the floor preferably defines an inclined position of about 5° in which its coke-supporting surface either slopes downwardly toward the coke-side bench or it slopes upwardly toward the coke-side bench. In the latter instance, a larger volume of coke is required to fill the container of the coke car in the area situated near the side wall of the coke car which is adjacent the oven platform. Experiments have shown that the top surface of a pile of coke falling into a container slopes toward both sides, i.e., in the longitudinal direction of the battery and toward the coke-side bench of the coke oven battery.

The coke-support floor of the coke car is preferably in the form of checkerwork and the sealing strip used to seal off the edge of the floor from the bottom edges of the container walls is situated on the top of the floor in that part thereof which is between the pivot axis and the coke-side bench while the seal strip is disposed on the underside portion of the floor situated toward the oven platform. The reason for this relationship of the seal strip is that the portion of the floor situated toward the coke-side bench is swung downwardly while the other section of the floor is swung upwardly when the floor is pivoted into a position for discharging coke from the car.

As just described, when the floor for the container of the car is pivoted into a position where it closes the bottom of the container, the floor is preferably inclined at an angle of about 5° to the horizontal so as to slope either downwardly toward the coke discharge side or in the reverse direction. In the former case, the angle through which the floor must be pivoted for the discharge of coke is reduced. In this instance, the volume of the container which can be filled with coke is larger, i.e., on the inside of the container where the pile of coke forms during pushing has a maximum height, as already described above.

The container back wall which faces toward the oven platform may take the form where a part of this wall is fixedly connected to the floor. In this instance, sealing strips are provided at the two side edges of the ball wall and bear against the two transverse walls.

The bottom part of the outer wall situated toward the coke-side bench is preferably formed with apertures that are closed by shutters including actuators that are hydraulically operated. During the quenching operation beneath the quenching tower, the shutters are operated to open the apertures for maintaining the water level inside the container at a suitable height, thus controlling the extent of coke quenching and wetting.

Grids can be disposed in front of the insides of the side walls to produce compartments into which no coke drops. The compartments form discharge chambers for water vapor emerging under high pressure during quenching. Before the coke is discharged from the container, the floor can be initially pivoted to a slight extent to provide a small aperture of, for example, 1–2 centimeters, at the outer wall so that water collecting on the floor is discharged without the risk of entrainment by the coke.

An advantage of the coke car of the present invention is that fumes or smoke formed during the pushing of the coke and dumping of the chamber content into the car while stationary are received in the hood which is fixed to the guide grid so that the smoke or fumes can be fed to a discharge pipe extending along the coke oven battery. The travel of the car to the quenching tower does not give rise to any appreciable pollution of the environment provided the coke is fully carbonized.

The quenching operation can be extensively controlled by a correct adjustment to the level of water accumulating on the floor of the coke car. This control is provided by the apertures, more specifically by the apertures in the container outer walls, which enable the water to be discharged from the car as required.

The outer wall of the container of the coke car can be extended upwardly to an extent such that any pieces of coke propelled upwardly from the coke rebound from this top part of the wall and are thrown backwardly into the container. Thus, this construction allows for pieces of coke that are propelled upwardly as may occur due to the explosive formation of vapors, to be returned to the container during the quenching operation.

Practical tests have shown that a suitable coke car embodying the features of the present invention can be made much shorter than the heretofore conventional inclined coke cars and that the width of an existing track for these known forms of cars is sufficient for a coke car of the present invention to receive carbonized coke even from a relatively tall oven chamber so that the entire chamber content can be accommodated in a suitably-dimensioned container of the coke car. Another important object of the present invention is the discharge of fumes formed during the pushing of coke and dumping of the coke into the car which is achieved with a relatively simple and easily-handled structure that can replace the heretofore conventional practice of using an inclined car without any appreciable conversion work.

These features and advantages of the present invention as well as others will be more fully understood when the following description of the preferred embodiment of the present invention is read in light of the accompanying drawings, in which.

Figure 1:
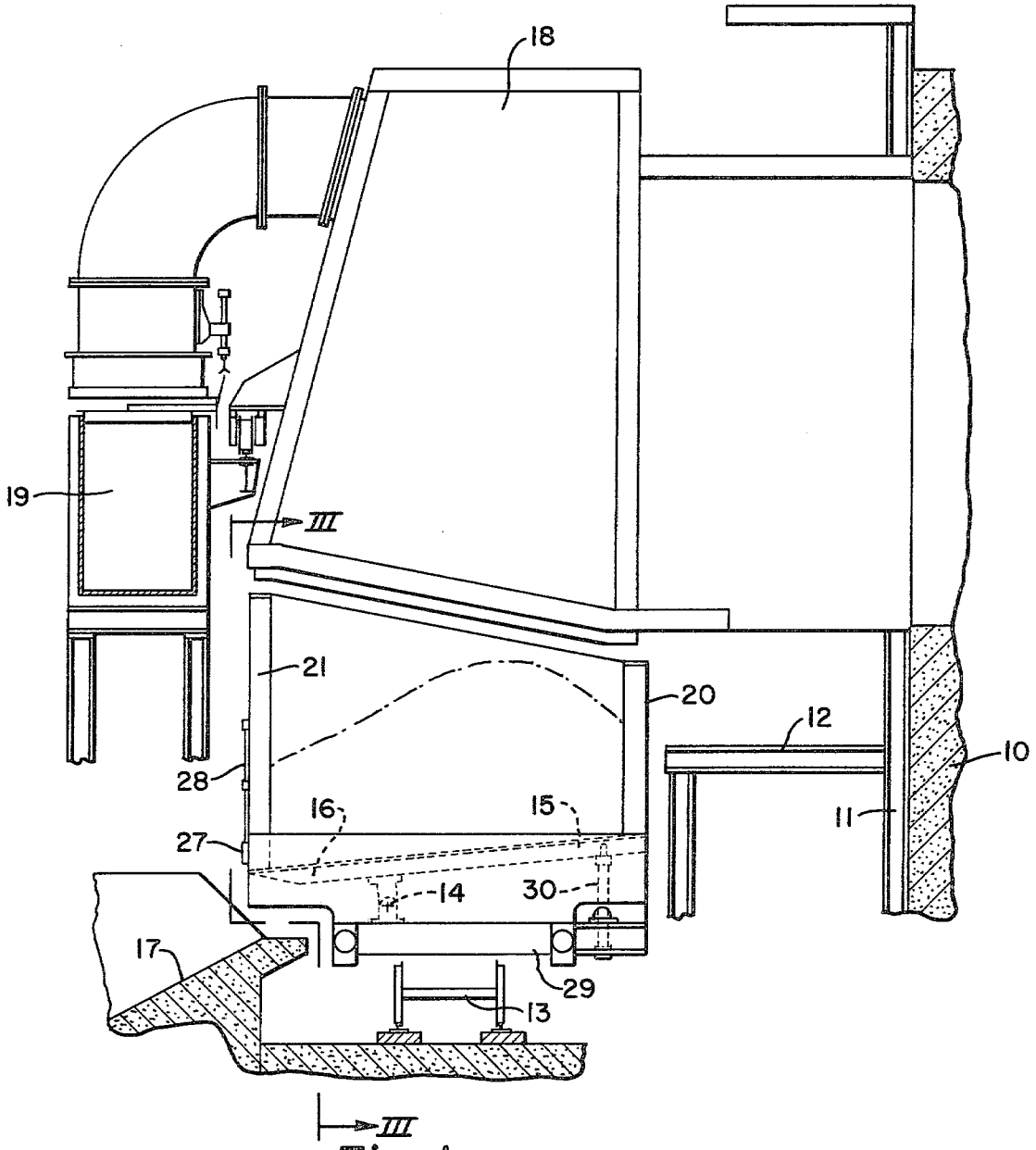
FIG. 1 is a vertical section taken along the central plane of an oven chamber, the oven platform, smoke-gas extraction system, the top edge of the coke-side bench and a coke car together with its support track embodying the present invention.

In FIG. 1 of the drawings, reference numeral 10 identifies brickwork forming part of a coke oven chamber and supported by buckstays 11. An oven platform 12 extends along the coke oven battery at the coke side of each oven chamber. Running gear 13 supports a coke car 29 for movement along a track that extends at an outwardly-spaced location from the oven platform. Reference numeral 14 identifies a horizontal pivot axis of a hinge support for the floor forming part of the coke car 29. As best shown in FIG. 1, the axis 14 is situated to form a wider inner floor part 15 and a shorter or narrower outer floor part 16. Reference numeral 17 identifies the coke-side bench. An extraction hood 18 is provided above the coke car to extract gases developing when hot coke is pushed and dumped into the coke car. A conduit 19 extends along the battery of coke ovens to conduct the gases from the smoke hood that occur during the pushing operation.

Turning now more specifically to the coke car of the present invention and as shown in FIGS. 1–5, the coke car includes a chamber having an inner wall 20 that extends along at a closely-spaced relation adjacent the oven platform 12. Opposite wall 20 is an outer wall 21 that extends along in a generally closely-spaced relation from the coke bench 17. The car further includes a side wall 22 at each of the opposite ends of the car. Grids 23 are closely spaced from the walls 20–22 to form compartments 24 (FIGS. 4 and 5) for discharging water vapor that forms explosively during quenching of the coke. The members forming grids 23 are spaced apart to prevent entrance of coke into compartments 24. The grids along wall 20 include a bottom part connected by a hinge member to floor part 15. The bottom part of the grid slideably receives an upper part that is held by a hinge along the top edge wall 20. A seal strip 25 is provided at the underside of inner floor part 15 which pivots in an upward direction upon rotary movement of the floor about axis 14. The seal strip 25 is provided on the checkerwork of the floor. A seal strip 26 is provided on the top of the shorter outer floor part which pivots downwardly during rotary movement of the floor about axis 14.

Figure 3:
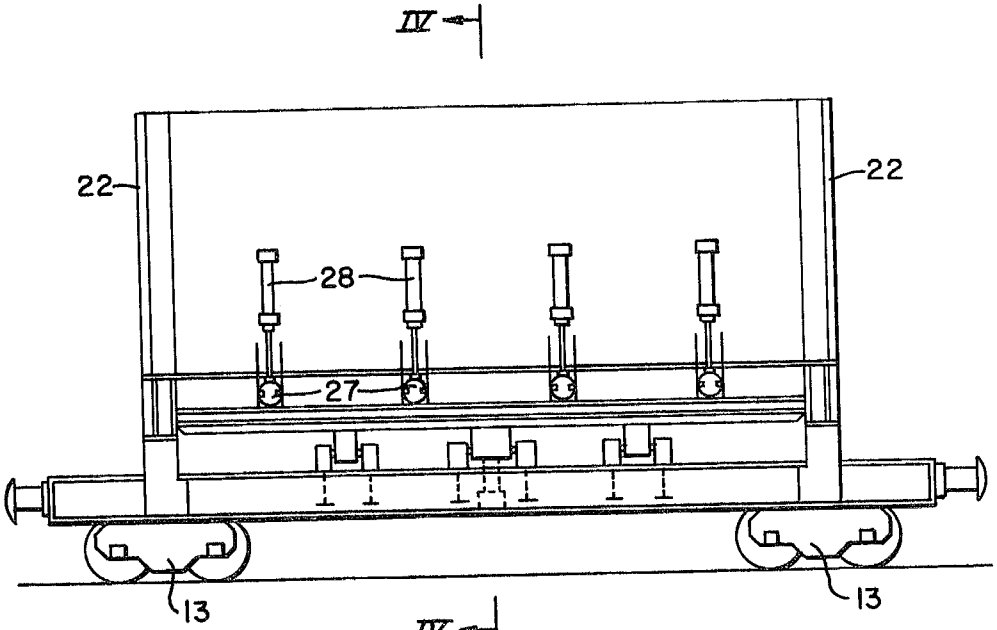
FIG. 3 is a front elevational view of the coke car shown in FIG. 1 looking toward the coke oven battery.
Figure 2:
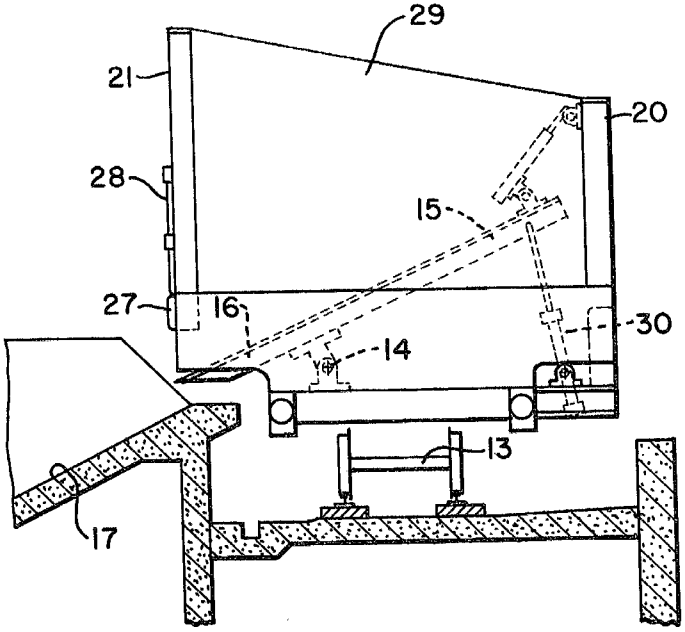
FIG. 2 is an elevational view, partly in section, illustrating the arrangement of the coke car during emptying of the quenched coke onto a coke-side bench.

The underframe of the car supports a piston and cylinder assembly 30 having its rod end coupled to the underside of the larger inner floor part 15 so that upon operation of the piston and cylinder assembly, the floor is pivoted about axis 14 from the position shown in FIG. 1 to the position shown in FIG. 2. As best shown in FIG. 3, apertures 27 are formed at spaced-apart locations in the bottom part of the outer wall 21. Shutters are controlled by actuators 28 to move the shutters relative to the apertures for selectively closing the openings thereof.

Figure 5:
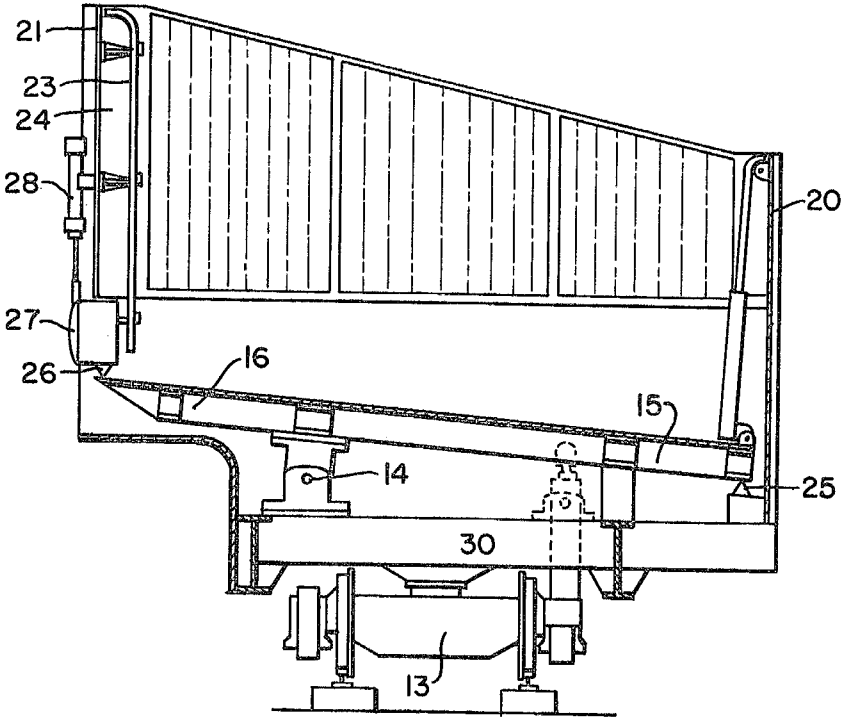
FIG. 5 is a view similar to FIG. 4 to illustrate a sloping arrangement of the floor which is opposite that illustrated in FIG. 4.
Figure 4:
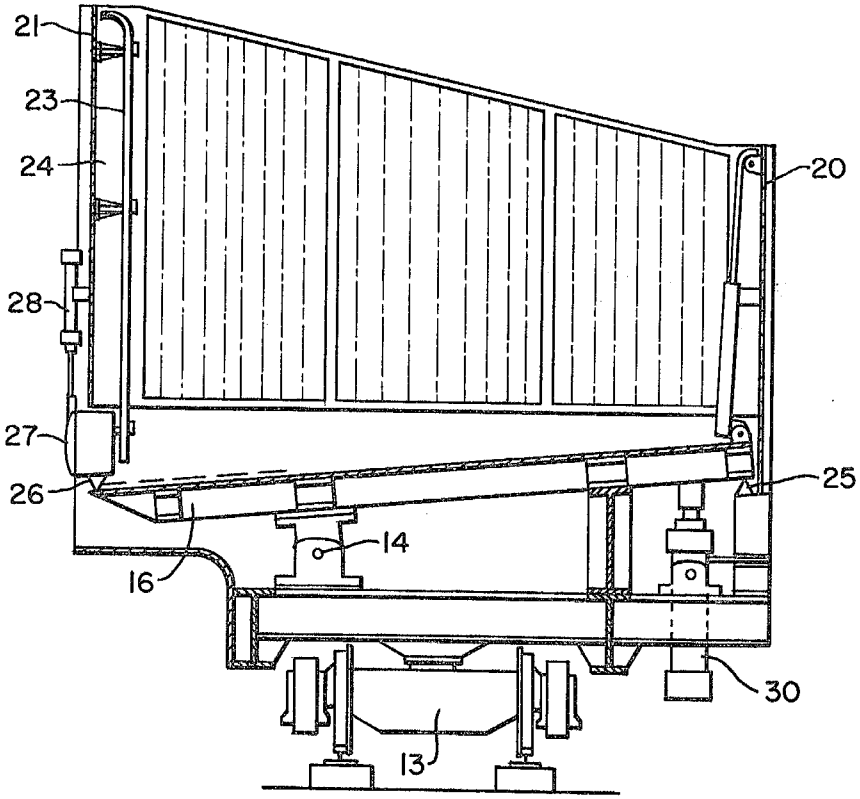
FIG. 4 is an end elevational view of the coke car to illustrate a sloping arrangement of the floor thereof in a direction toward the oven chambers for loading and quenching.

In FIGS. 1 and 3, the top surface of a pile of coke formed in the coke car after pushing from an oven chamber is identified by phantom lines. In the arrangement of parts forming the coke car shown in FIG. 4, the floor of the coke car made up of floor parts 15 and 16 forms a coke-support surface that slopes downwardly from a higher elevation at the inner wall 20 which is adjacent the oven platform to a lower elevation at the outer wall 21 which is adjacent the coke bench. In FIG. 5, floor parts 15 and 16 slope in the opposite direction, namely from a lower elevation at inner wall 20 adjacent the oven platform to a higher elevation at outer wall 21 adjacent the coke bench. The slope of the floor of the coke car is preferably about 5°. As can be seen by a comparison of FIGS. 4 and 5, the coke capacity of a car having a floor sloping downwardly toward the ovens (FIG. 5) is larger than that of the car shown in FIG. 4 where the floor slopes upwardly toward the ovens. As described hereinbefore, the height of the pile of coke in a car when discharged from an oven chamber has a greater height along wall 20 than along wall 21 and the greater depth to the car along wall 20 provides the increased coke carrying capacity.

Thus, the present invention provides a coke car which, when stationary, receives carbonized coke from an oven chamber and adapted to travel along the battery of coke ovens and beneath a quenching tower. The present invention provides a one-point coke car and contrary to the usual practice with known forms of cars having an inclined sloping surface, the car remains stationary during the coke pushing operation. In this regard, the inclined loading surface of the usual forms of coke cars is situated so that its top end is immediately beneath the oven platform over which the carbonized coke cake is pushed. The bottom edge of the car floor is situated above the top edge of the coke-side bench onto which the quenched coke is discharged. A car embodying this known design is moved longitudinally of the coke oven battery during the actual coke pushing operation in order to distribute the load of hot coke over the entire length of the inclined surface of the car. The container for the coke car according to the present invention has a generally square-box design of appropriate depth. The pivotal arrangement of the floor for the car provides that the floor can move between two pivoted positions; that is, a substantially horizontal position which, if required, may be inclined by about 5° to the horizontal and in this position the floor forms the bottom closure for the box-like container of the car. In the pivoted position, the floor is inclined into a position in which the top surface substantially forms a continuation of the coke-support surface of the coke-side bench. As described previously, the distance between the pivot axis and the coke-side bench is less than the distance between the pivot axis and the oven platform to insure an adequate discharge opening for coke when the floor is pivoted upwardly about axis 14.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A coke car to travel along a battery of coke ovens and a coke bench for receiving carbonized coke when stationary from an oven chamber for moving to beneath a quenching tower, said battery of coke ovens having an oven platform at the coke discharge side thereof, said car including a generally square box-like container having stationary inner and outer side walls with a seal means at the bottoms thereof, a floor adapted to bear against said seal means through pivotal movement about a single horizontal axis extending in the direction of travel by the car so that pivoting said floor into a swung-up position permits quenched coke to fall onto said coke bench at only one side thereof, part of said seal means being disposed to engage with a top portion of said floor at said outer side wall which extends parallel to said horizontal axis at said coke bench and part of said seal means being disposed to engage with the underside portion of said floor at said inner side wall which extends parallel to said horizontal axis at said oven platform, and pivotal means for said floor defining said horizontal axis which is spaced from said coke bench when the car is opposite thereto by a distance less than the distance between said horizontal axis and said oven platform when the car is opposite thereto.

2. The coke car according to claim 1 wherein said floor includes a checkerwork.

3. The coke car according to claim 1 wherein the coke-engaging face of said floor slopes downwardly to the horizontal in an inclined manner by about 5° toward said coke bench when the floor forms a bottom closure with said side walls.

4. The coke car according to claim 1 wherein the coke-engaging face of said floor slopes downwardly to the horizontal in an inclined manner by about 5° toward said oven platform when the floor forms a bottom closure with said side walls.

5. The coke car according to claim 1 wherein said side walls include grid members spaced from wall members to define discharge chambers to receive quenching vapors.

6. The coke car according to claim 1 wherein said side walls include a back wall having a wall part fixedly connected to said floor, said back wall being adjacent said oven platform when said car is opposite thereto.

7. The coke car according to claim 1 wherein said side walls include a front wall having a bottom part with apertures therein, and shutters moved by actuators for closing said apertures, said front wall being adjacent said coke bench when said car is opposite thereto.

* * * * *